US009551136B2

(12) United States Patent
Keiter et al.

(10) Patent No.: US 9,551,136 B2
(45) Date of Patent: Jan. 24, 2017

(54) MULTIPLE FLOW FAUCET WITH PIVOTING SPOUT

(71) Applicant: Grohe AG, Hemer (DE)

(72) Inventors: Dieter Keiter, Menden (DE); Matthias Schlueter, Dortmund (DE); Martin Weiss, Schwerte (DE)

(73) Assignee: Grohe AG, Hemer (DE)

( * ) Notice: Subject to any disclaimer, the term of this patent is extended or adjusted under 35 U.S.C. 154(b) by 408 days.

(21) Appl. No.: 13/946,401

(22) Filed: Jul. 19, 2013

(65) Prior Publication Data

US 2014/0027372 A1 Jan. 30, 2014

(30) Foreign Application Priority Data

Jul. 30, 2012 (DE) ..... 10 2012 014 947

(51) Int. Cl.
*E03C 1/04* (2006.01)
*E03C 1/048* (2006.01)

(52) U.S. Cl.
CPC ..... *E03C 1/0404* (2013.01); *E03C 1/048* (2013.01); *E03C 2201/30* (2013.01); *E03C 2201/40* (2013.01)

(58) Field of Classification Search
CPC .... E03C 1/0404; E03C 1/048; E03C 2201/30; E03C 2201/40
USPC ..... 210/449, 420; 137/801, 615; 4/675, 676, 4/678; 239/525, 588
See application file for complete search history.

(56) References Cited

U.S. PATENT DOCUMENTS

| | | | | |
|---|---|---|---|---|
| 6,321,788 | B1 | 11/2001 | Egli | |
| 2009/0200794 | A1 | 8/2009 | Esche et al. | |
| 2011/0030823 | A1* | 2/2011 | Seal et al. | 137/603 |

FOREIGN PATENT DOCUMENTS

| | | | |
|---|---|---|---|
| DE | 198 50 839 | A1 | 5/2000 |
| WO | WO 2008/125865 | A1 | 10/2008 |

* cited by examiner

*Primary Examiner* — Madeline Gonzalez
(74) *Attorney, Agent, or Firm* — Muncy, Geissler, Olds & Lowe, P.C.

(57) ABSTRACT

A multiple flow faucet with passages having at least one base part installed in a mounting element, and a pivoting spout rotatably attached thereto, with at least a cold water line and a filtered water line. The filtered water line has at least one liquid-tight rotatable disconnection point at one or more of the passages.

11 Claims, 2 Drawing Sheets

MULTIPLE FLOW FAUCET WITH PIVOTING SPOUT

This nonprovisional application claims priority under 35 U.S.C. §119(a) to German Patent Application No. DE 10 2012 014 947.6, which was filed in Germany on Jul. 30, 2012, and which is herein incorporated by reference.

BACKGROUND OF THE INVENTION

Field of the Invention

The present invention relates to a multiple flow faucet having at least one base part installed in a mounting plane and a pivoting spout rotatably attached thereto with at least a cold water line, a filtered water line, and an electronic signal line.

Description of the Background Art

Faucets typically find application in the household area. These faucets are most especially suited for use in both private and commercial kitchen areas. The dual flow nature of the faucet is required in order to separate a first water flow with warm water—mixed from cold water and hot water—from another water flow having filtered water. To this end, for processing as drinking water, tap water is routed through special filters and is thus treated. With multiple flow faucets of this type it is possible to draw filtered water or any desired mixture of warm water from a single tap without mixing the water flows. It is necessary and desirable for this purpose for the spout of the faucet to be designed as a pivoting spout, as is known from kitchen faucets, for example.

Thus, a pivoting spout with a mixing valve is known from DE 198 50 839 A1, which corresponds to U.S. Pat. No. 6,321,788. The pivoting spout known therefrom permits any desired pivoting of the spout, wherein two separate lines for hot and cold water extend within the pivoting spout to an opening. A mixing cartridge for hot and cold water is located at the opening. The prior art pivoting spout is cumbersome to install, however, and moreover is not suited to carry mixed water and filtered water separately from one another as desired.

SUMMARY OF THE INVENTION

It is therefore an object of the present invention to solve the problems arising from the prior art, and in particular to specify a multiple flow faucet with a rotatable pivoting spout that is simple to install and has a long service life.

In an embodiment, the faucet is distinguished in that the filtered water line has at least one liquid-tight rotatable disconnection point. The filtered water line is routed within the faucet at least approximately parallel to a mixed water line. The parallel routing of the filtered water line and mixed water line results in a dual flow design of the faucet. However, in principle the invention can also be used in faucets with three or more flows. While the mixed water line is pivotable and rotatably attached to the base part in a known manner, the filtered water line located inside the mixed water line would be twisted during pivoting of the pivotable spout according to the prior art. In order to avoid this, the present invention in an embodiment provides a disconnection point inside the filtered water line, which permits a relative motion in the form of a rotation of sections of the filtered water line with respect to one another while simultaneously providing liquid-tight shielding of the filtered water line with respect to the outside. The wear and material stress on the filtered water line can be significantly reduced over the service life of the faucet by means of the invention, since twisting of the filtered water line during pivoting of the pivoting spout is eliminated. Moreover, the filtered water line according to the invention can be installed in an especially simple manner in that, for example, it is inserted into the faucet from the spout side with preinstalled fittings such as, e.g., an aerator, and is only then installed at the bottom end in the region of the disconnection point.

To this end, it is advantageous for the disconnection point to be located at a bottom of the base part. This location is still accessible without difficulty even at a later time, so that installation or repair work can be carried out without difficulty.

In an embodiment the disconnection point can include a pivoting nipple and a fixed nipple. In this design, the section of the filtered water line entering the faucet is screwed to the bottom of the base part by means of a fixed nipple. In the installed or screwed-on state, the fixed nipple in this embodiment encloses the pivoting nipple in a leakproof manner, which in turn is connected to the pivoting section of the filtered water line located above. Located between the fixed nipple and the pivoting nipple is a sealing that efficaciously prevent the escape of filtered water at the disconnection point between the two filtered water sections. Moreover, the pivoting nipple is coaxial to the fixed nipple in its orientation and can execute a rotary motion inside the fixed nipple without difficulty.

In an embodiment, at least one seal and one fastener can be provided for each of the ends of the filtered water line at the disconnection point. In this way, the ends of the filtered water line, which is implemented as a flexible hose, for example, can be connected to the rigid and pivoting nipples without difficulty.

The filtered water line can be designed as a plastic hose. Polyethylene (PET) plastics are especially suitable for this purpose. Plastics of this type have high strength, are food safe, and hence are especially suitable for use in faucets for drawing filtered water.

In another embodiment, provision is made for the base part to additionally include a mixing part. The integration of a mixing part in the base part makes it possible at the same time to route the top section of the filtered water line through the mixing part to the bottom of the base part. The mixed water line provided for routing of the mixed water can thus start in the mixing part above the disconnection point and extend from there to the opening of the pivoting spout, with the filtered water line being enclosed. While known valve arrangements such as, e.g., single-lever cartridges or thermostatic cartridges, can be used for mixing hot and cold water in the mixing part, with the continuously routed filtered water line an additional medium can be routed to the opening such that it is continuously isolated from the mixed water.

In an embodiment, the fixed nipple can be rigidly connected to the bottom of the base part. The connection between the fixed nipple and the bottom of the base part can be accomplished via a screw thread, for example. The fixed nipple can be fastened to the bottom by simply screwing it in. With a corresponding receptacle for the pivoting nipple, it is then possible to enclose the pivoting nipple projecting downward from the base part and to seal it off liquid-tight against the outside. While the top section of the filtered water line in this arrangement is freely movable together with the pivoting nipple, the fixed nipple rigidly connected to the bottom provides the necessary mechanical stability for receiving the bottom section of the filtered water line, serves to seal the disconnection point relative to the outside, and serves as a rotary bearing for rotatable support of the pivoting nipple.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
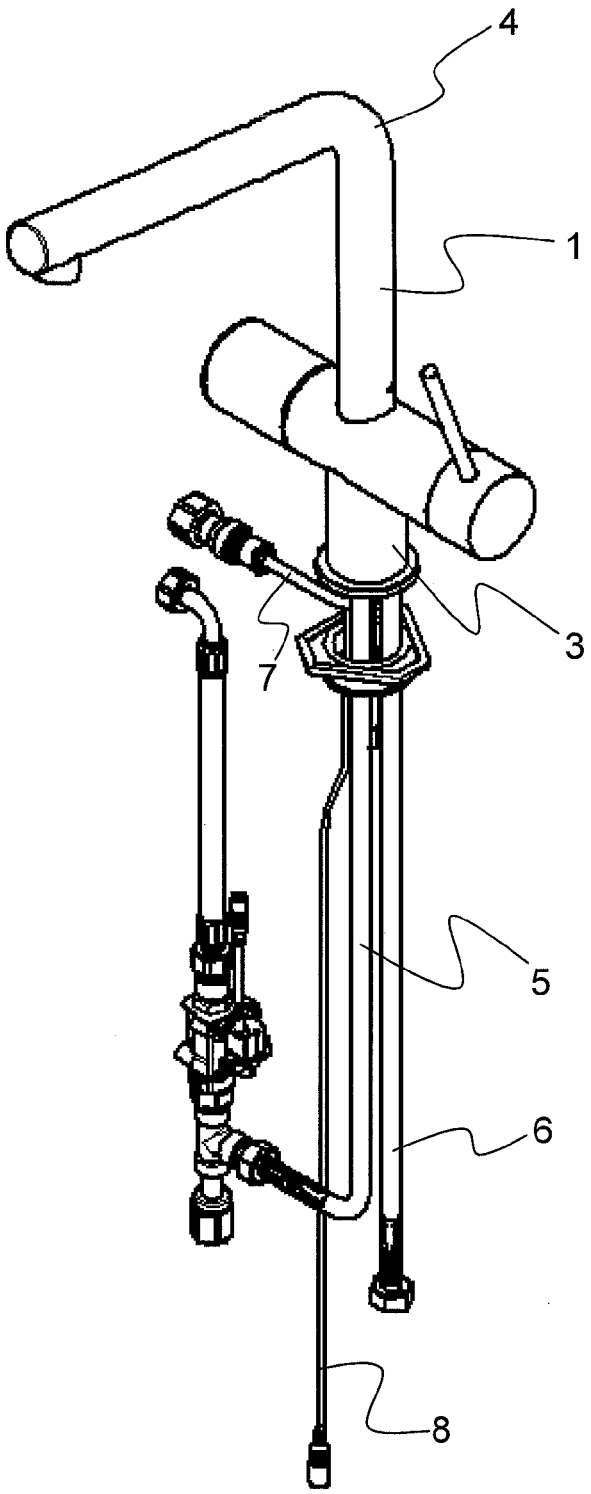
FIG. 1 is an oblique view of a faucet according to an embodiment the invention.
Figure 2:
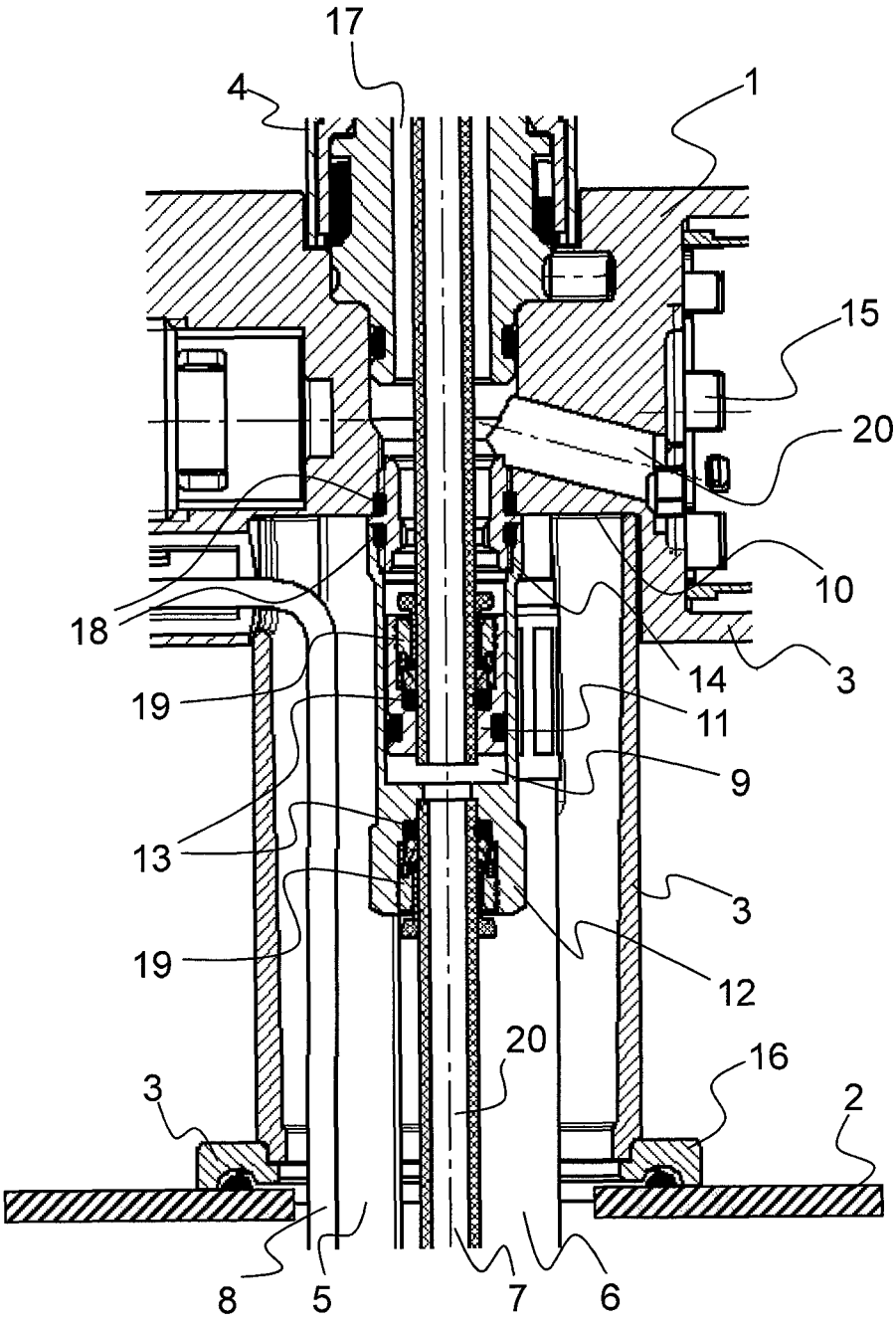
FIG. 2 is a cross-sectional view through a base part of a faucet according to an embodiment of the invention.

FIG. 1 shows a dual-flow faucet 1, which can be installed on a mounting element 2 shown in FIG. 2. The bottom region of the faucet 1 is comprised of a base part 3 on which a pivoting spout 4 sits. A cold water line 5, a hot water line 6, a filtered water line 7, and a signal line 8 lead into the base part 3 of the faucet 1 from below.

FIG. 2 shows a cross-sectional view through the base part 3 from FIG. 1. The base part 3 is installed on a mounting element 2. The mounting element 2 can be a kitchen work surface, for example. Shown within the base part 3 is a disconnection point 9, which separates a top section of the filtered water line 7 and a bottom section of the filtered water line 7. The disconnection point 9 is composed of a pivoting nipple 11 and a fixed nipple 12, which are located at a bottom 10 of the base part 3. The base part 3 also has a mixing part 15, which serves to mix hot and cold water. Located in the mixing part 15 is a ceramic cartridge with which passages for hot and cold water can be opened and closed individually or simultaneously, so that any desired flow rates and mixing ratios can be selected within certain limits. Also located at the bottom 10 of the base part 3 is an adapter 16 that is provided to compensate for tolerances of a hole cutout in the mounting element 2 and to cover the gaps that are present. Provided between the fixed nipple 12 and the pivoting nipple 11 is a first seal 13, which prevent an escape of filtered water at the disconnection point 9. Further above, in the region of a threaded attachment of the pivoting nipple 12, which represents a first fastener 14, a second seal 18 are provided on the bottom 10, additionally preventing the exit of fluid from the fixed nipple 12. The ends of the filtered water line 7 are fastened into the respective nipples 11,12 by insertion of the hose end into the applicable nipple, wherein the hose end is surrounded by a sealing ring of the first seal 13. Final mechanical securing is accomplished by the insertion of an insert 19. To install the insert 19, it is only necessary for a ring surrounding the filtered water line 7 to be pushed into the applicable nipple (11,12), by which means the hose is clamped and thus mechanically retained. The insert 19 thus constitutes a second fastener for connecting the ends of the filtered water line to the applicable nipples 11, 12 in a permanent and liquid-tight manner. Also easily recognizable in FIG. 2 is that a mixed water line 17 first begins in the top region of the base part 3, and concentrically encloses the filtered water line 7. When the pivoting spout 4 is pivoted, the top section of the filtered water line 7 can now move with complete freedom relative to the stationary bottom section of the filtered water line 7 on account of the design according to the invention of the faucet 1. Due to the disconnection 9, the twisting of the filtered water line 7 that was previously necessary is efficaciously avoided. This has positive effects on the service life and liquid-tightness of the faucet. It is also quite evident that replacement of the filtered water line 7 can be accomplished by simple unscrewing of the fixed nipple 12 from the bottom 10 of the base part 3, and that the faucet 1 is thus also especially easy to maintain.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A multiple flow faucet with passages comprising:

at least one base part that is configured to be installed on a mounting element;

a pivoting spout rotatably attached to the at least one base part;

a cold water line extending into the at least one base part;

a filtered water line having at least two disconnected water line sections, the filtered water line having at least one liquid-tight, rotatable disconnection point at opposing ends of the at least two disconnected water line sections, wherein the disconnection point comprises a pivoting nipple that is rotatable and a fixed nipple that is stationary, the pivoting nipple being disposed concentrically inside of the fixed nipple.

2. The faucet according to claim 1, wherein the disconnection point is located at a bottom of the base part.

3. The faucet according to claim 1, wherein the pivoting nipple is enclosed in a leakproof manner by the fixed nipple.

4. The faucet according to claim 1, wherein at least one seal and at least one fastener are provided for each of the ends of the filtered water line at the disconnection point.

5. The faucet according to claim 1, wherein the filtered water line is a plastic pipe or hose.

6. The faucet according to claim 1, wherein the base part includes a mixing part.

7. The faucet according to claim 1, wherein the fixed nipple is rigidly connected to the bottom of the base part.

8. The faucet according to claim 1, wherein the opposing ends of the at least two disconnected water line sections include one end of a first section and one end of a second section of the at least two disconnected water line sections, wherein the one end of the first section of the at least two disconnected water line sections is inserted in the fixed nipple and extends from the one end towards the mounting element.

9. The faucet according to claim 8, wherein the one end of the second section of the at least two disconnected water line sections is inserted in the pivoting nipple and extends from the one end towards and into the pivoting spout.

10. The faucet according to claim 9, wherein the first section of the at least two disconnected water line sections is stationary and the second section of the at least two disconnected water line sections is rotatable.

11. The faucet according to claim 1, wherein the cold water flows from the cold water line to the pivoting spout while remaining at an exterior of the pivoting nipple and an exterior of the fixed nipple.

* * * * *